US007682500B2

(12) United States Patent
Kalnes

(10) Patent No.: US 7,682,500 B2
(45) Date of Patent: Mar. 23, 2010

(54) HYDROCARBON CONVERSION PROCESS

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 643 days.

(21) Appl. No.: 11/007,469

(22) Filed: Dec. 8, 2004

(65) Prior Publication Data

US 2006/0118464 A1 Jun. 8, 2006

(51) Int. Cl.

| | |
|---|---|
| ***C10G 45/00*** | (2006.01) |
| *C10G 47/00* | (2006.01) |
| *C10G 65/00* | (2006.01) |
| *C10G 69/00* | (2006.01) |
| *C10M 109/00* | (2006.01) |

(52) U.S. Cl. ..... 208/89; 208/58; 208/59; 208/97; 208/107; 208/108; 208/142; 208/210; 208/213; 585/1

(58) Field of Classification Search ..... 208/89, 208/213, 58–59, 97, 107–108, 142, 210; 585/1

See application file for complete search history.

(56) References Cited

U.S. PATENT DOCUMENTS

| | | | | |
|---|---|---|---|---|
| 3,260,663 | A | 7/1966 | Inwood et al. | |
| 3,328,290 | A * | 6/1967 | Hengstebeck | 208/89 |
| 3,583,902 | A | 6/1971 | Masologites et al. | |
| 3,668,112 | A | 6/1972 | Parker et al. | |
| 4,713,167 | A * | 12/1987 | Reno et al. | 208/59 |
| 6,096,191 | A | 8/2000 | Kalnes | 208/105 |
| 6,224,747 | B1 * | 5/2001 | Cash et al. | 208/58 |
| 6,315,889 | B1 | 11/2001 | Thakkar et al. | |
| 6,451,197 | B1 * | 9/2002 | Kalnes | 208/58 |
| 6,514,403 | B1 * | 2/2003 | Louie et al. | 208/58 |
| 6,547,956 | B1 * | 4/2003 | Mukherjee et al. | 208/58 |
| 6,596,155 | B1 * | 7/2003 | Gates et al. | 208/89 |
| 6,638,418 | B1 * | 10/2003 | Kalnes et al. | 208/89 |
| 2003/0111387 | A1 * | 6/2003 | Mukherjee et al. | 208/89 |

* cited by examiner

*Primary Examiner*—Walter D Griffin
*Assistant Examiner*—Natasha Young
(74) *Attorney, Agent, or Firm*—James C Paschall

(57) ABSTRACT

A process for the conversion of a feedstock containing light cycle oil and vacuum gas oil to produce naphtha boiling range hydrocarbons and a higher boiling range hydrocarbonaceous stream having a reduced concentration of sulfur.

20 Claims, 1 Drawing Sheet

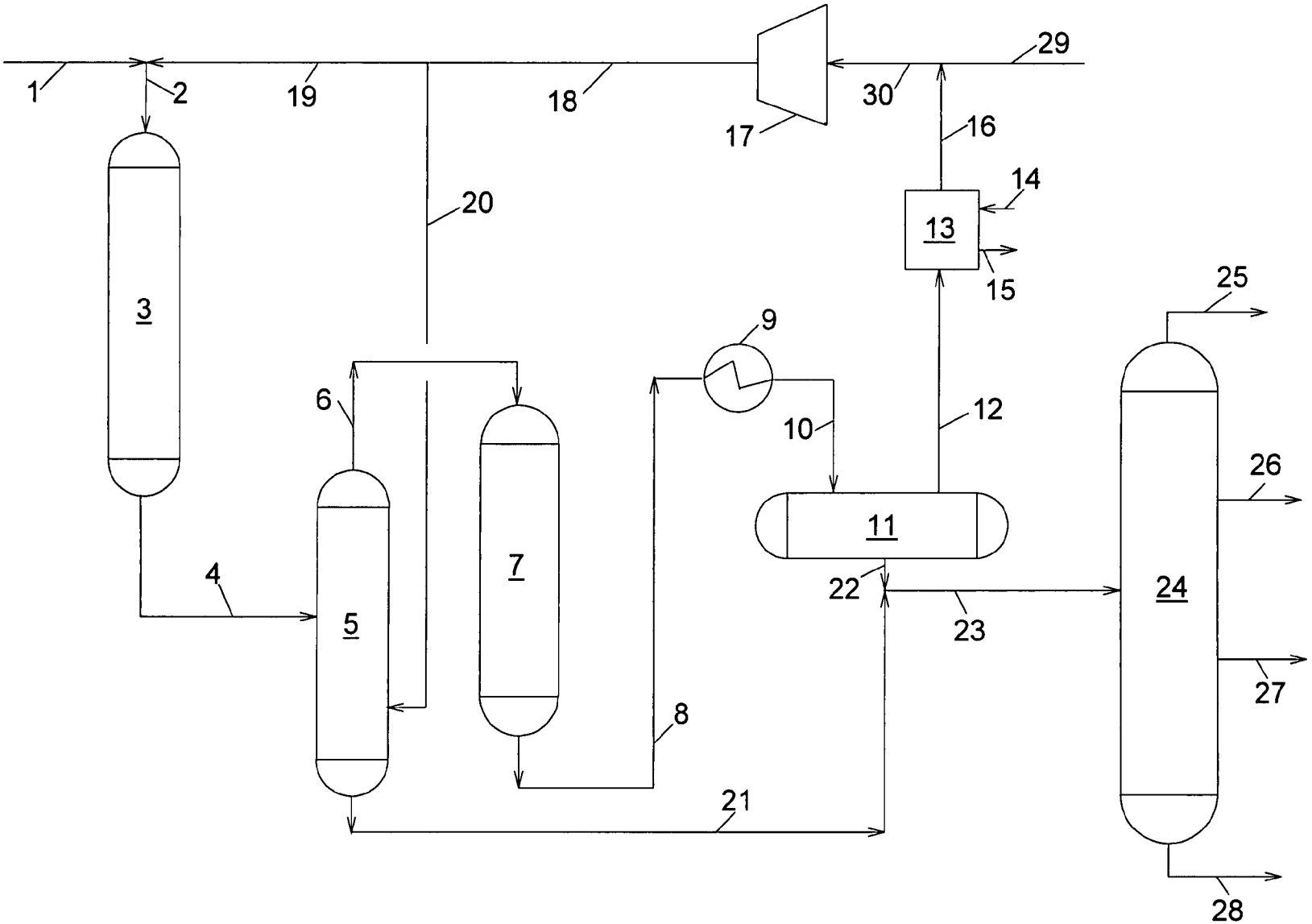
1
2
3
4
5
6
7
8
9
10
11
12
13
14
15
16
17
18
19
20
21
22
23
24
25
26
27
28
29
30

HYDROCARBON CONVERSION PROCESS

BACKGROUND OF THE INVENTION

The field of art to which this invention pertains is the hydrodesulfurization and hydrocracking of a hydrocarbonaceous feedstock comprising light cycle oil and vacuum gas oil. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oil recovered from crude oil by distillation. A typical gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.). A light cycle oil (LCO) is produced during the fluid catalytic cracking (FCC) of gas oil feedstocks to primarily produce gasoline boiling range hydrocarbons. Light cycle oil is an undesirable refractory by-product of the FCC process and therefore is a low value product. Previously, LCO was blended into the diesel pool or used as cutter stock for heavy fuel oil. These traditional outlets are being diminished or eliminated because of the demands of the marketplace. LCO generally boils in the range of about 149° C. (300° F.) to about 371° C. (700° F.).

Although a wide variety of process flow schemes, operating conditions and catalysts have been used in commercial hydrodesulfurization and hydrocracking activities, there is always a demand for new methods which provide more useful products from distressed feedstocks and to provide improved product characteristics. The present invention is able to economically hydrocrack the LCO in an integrated process while simultaneously desulfurizing the higher boiling components of the feedstock. These higher boiling components of the feedstock with a reduced concentration of sulfur compounds are an ideal feedstock for an FCC unit.

INFORMATION DISCLOSURE

U.S. Pat. No. 6,096,191 B1 discloses a catalytic hydrocracking process wherein a hydrocarbonaceous feedstock and a liquid recycle stream are contacted with hydrogen and a hydrocracking catalyst to obtain conversion to lower boiling hydrocarbons. The resulting effluent from the hydrocracking zone is hydrogen stripped at essentially the same pressure as the hydrocracking zone and at least a portion is recycled to the hydrocracking reaction zone.

BRIEF SUMMARY OF THE INVENTION

The present invention is an integrated process for the hydrodesulfurization and hydrocracking of a hydrocarbonaceous feedstock comprising light cycle oil and vacuum gas oil. The feedstock is reacted in a hydrodesulfurization reaction zone to produce a hydrocarbonaceous stream having a reduced concentration of sulfur which stream is preferably separated in a hot, high pressure stripper to produce a vaporous hydrocarbonaceous stream boiling in the range from about 10° C. (50° F.) to about 510° C. (950° F.) and a liquid hydrocarbonaceous stream having a reduced concentration of sulfur and boiling in a range greater than the vaporous hydrocarbonaceous stream. The hydrocarbonaceous stream having a reduced concentration of sulfur may also be separated in a separation zone such as a fractionator but is less economically desirable. The vaporous hydrocarbonaceous stream boiling in the range from about 10° C. (50° F.) to about 510° C. (950° F.) is reacted in a hydrocracking reaction zone containing hydrocracking catalyst to produce an effluent stream comprising naphtha boiling range hydrocarbons.

Other embodiments of the present invention encompass further details such as types and descriptions of feedstocks, hydrodesulfurization catalysts, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and is not intended to be a limitation thereof.

DETAILED DESCRIPTION OF THE INVENTION

An integrated hydrodesulfurization and hydrocracking process has been discovered which is capable of converting a hydrocarbonaceous feedstock containing light cycle oil and vacuum gas oil to produce a naphtha boiling range hydrocarbon stream and a higher boiling hydrocarbonaceous stream having a reduced concentration of sulfur.

The feedstock contains light cycle oil which is an undesirable by-product produced in an FCC unit while converting vacuum gas oil to gasoline. Light cycle oil is an economical and advantageous feedstock since it is undesirable as a finished product and contains significant quantities of sulfur, nitrogen and polynuclear aromatic compounds. Therefore, the present invention is able to convert a feedstock containing low-value LCO and vacuum gas oil into a valuable naphtha boiling range hydrocarbon stream and a desirable feed for a fluid catalytic cracking process.

In accordance with the present invention, the selected feedstock is introduced into a hydrodesulfurization reaction zone together with hydrogen at hydrodesulfurization conditions preferably including a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$.

The term "hydrodesulfurization" as used herein refers to processes wherein a hydrogen-containing treat gas is used in the presence of suitable catalysts which are primarily active for the removal of heteroatoms, such as sulfur and nitrogen. Suitable hydrodesulfurization catalysts for use in the present invention are any known conventional hydrodesulfurization catalyst and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrodesulfurization catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the hydrodesulfurization zone is preferably introduced into a hot, high pressure stripper preferably operated at a temperature from about 149° C. (300° F.) to about 400° C. (752° F.) and a pressure from about 3.5 MPa (500 psig) to about 17.3 MPa (2500 psig) to produce a vaporous hydrocarbonaceous stream boiling in the range from about 10° C. (50° F.) to about 510° C. (950° F.) and a liquid hydrocarbonaceous stream having a reduced concentration of sulfur and boiling in a range greater than the vaporous hydrocarbonaceous stream. The hot, high pressure stripper is preferably stripped with a hydrogen-rich recycle gas in an amount selected to send at least a majority of hydrocarbons boiling at a temperature below about 343° C. (650° F.) overhead. The hydrocarbonaceous stream having a reduced concentration of sulfur may also be separated in a separation zone such as a fractionator.

In accordance with one embodiment of the present invention the resulting vaporous hydrocarbonaceous stream from the hot, high pressure stripper is introduced into a hydrocracking zone. The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenation components. In another embodiment, the hydrocracking zone contains a catalyst which comprises, in general, any crystalline zeolite cracking base upon which is deposited a minor proportion of a Group VIII metal hydrogenating component. Additional hydrogenation components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms. It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms, wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like, if desired, and calcined in air at temperatures of e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking reaction zone is conducted in the presence of hydrogen and preferably at hydrocracking reaction zone conditions which include a temperature from about 232° C. (450° F.) to about 468° C. (875° F.), a pressure from about 3.5 MPa (500 psig) to about 17.3 MPa (2500 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 $m^3/m^3$ (25000 standard cubic feet per barrel). In accordance with the present invention, the hydrocracking conditions are selected on the basis of the vaporous hydrocarbon stream with the objective of the production of naphtha boiling range hydrocarbons.

The resulting effluent from the hydrocracking zone is cooled, partially condensed and introduced into a cold high pressure separator preferably operated at a temperature from about 16° C. (60° F.) to about 71° C. (160° F.) and a pressure from about 3.5 MPa (500 psig) to about 17.3 MPa (2500 psig). A hydrogen-rich gaseous stream is removed from the cold high pressure separator and preferably scrubbed with an absorbent to remove hydrogen sulfide. A resulting hydrogen rich gaseous stream having a reduced hydrogen sulfide concentration is compressed and recycled to the hydrodesulfurization zone and the hot, high pressure stripper. Make-up hydrogen may be introduced into the process at any convenient location to maintain the desired pressure and provide a reactant to the hydrodesulfurization and hydrocracking reaction zones.

A liquid hydrocarbonaceous stream is removed from the cold high pressure separator and is separated, preferably by fractionation to produce normally gaseous hydrocarbons, naphtha boiling range hydrocarbons and middle distillate boiling range hydrocarbons. The hydrocracking reaction zone is preferably operated to yield a majority of naphtha boiling range hydrocarbons.

The liquid hydrocarbonaceous stream having a reduced concentration of sulfur and boiling in a range greater than the vaporous hydrocarbonaceous stream is recovered in a preferred embodiment from the hot, high pressure stripper and preferably separated by fractionation to produce a hydrocarbonaceous stream which is an ideal and preferred candidate for a feedstock for a fluid catalytic cracking unit.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feedstock containing light cycle oil and vacuum gas oil is introduced into the process via line 1 and is admixed with a hydrogen-rich recycle gas provided via line 19 and the resulting admixture is transported via line 2 and introduced into hydrodesulfurization reaction zone 3. A resulting effluent from hydrodesulfurization reaction zone 3 is carried via line 4 and introduced into hot, high pressure stripper 5. A vaporous hydrocarbonaceous stream is removed from hot, high pressure stripper 5 via line 6 and introduced into hydrocracking reaction zone 7. A resulting hydrocracked effluent is removed from hydrocracking zone 7 via line 8 and introduced into heat exchanger 9. A resulting cooled and partially condensed hydrocarbonaceous stream is removed from heat exchanger 9 via line 10 and introduced into cold, high pressure separator 11. A hydrogen-rich gaseous stream is removed from cold, high pressure separator 11 via line 12 and introduced into absorption zone 13 and contacted with a lean absorption solution provided by line 14 to remove hydrogen sulfide. A rich absorption liquid is removed from absorption zone 13 via line 15 and recovered. A hydrogen-rich gaseous stream having a reduced concentration of hydrogen sulfide is removed from absorption zone 13 via line 16 and is admixed with a hydrogen make up stream provided via line 29 and the resulting admixture is carried via line 30 and introduced into compressor 17. A compressed hydrogen-rich gaseous stream is removed from compressor 17 via line 18 and a first portion is carried via line 19 and is introduced into hydrodesulfurization zone 3 via lines 19 and 2. A second portion of the compressed hydrogen-rich gaseous stream is carried via line 20 and introduced into hot, high pressure stripper 5. A liquid hydrocarbonaceous stream is removed from cold, high pressure separator 11 via line 22 and introduced into fractionation zone 24 via lines 22 and 23. A liquid hydrocarbonaceous stream is removed from hot, high pressure stripper 5 via line 21 and introduced into fractionation zone 24 via lines 21 and 23. A normally gaseous hydrocarbon stream is removed from fractionation zone 24 via line 25 and recovered. A naphtha boiling range hydrocarbon stream is removed from fractionation zone 24 via line 26 and recovered. A middle distillate hydrocarbon stream is removed from fractionation zone 24 via line 27 and recovered. A heavy distillate hydrocarbon stream is removed from fractionation zone 24 via line 28 and recovered.

The foregoing description and drawing clearly illustrate the advantages encompassed by the process of the present invention and the benefits to be afforded with the use thereof.

What is claimed is:

1. A process for the conversion of a hydrocarbonaceous feedstock wherein the process comprises:

(a) reacting a hydrocarbonaceous feedstock comprising light cycle oil and vacuum gas oil in a hydrodesulfurization reaction zone to produce a hydrocarbonaceous stream having a reduced concentration of sulfur;

(b) introducing at least a portion of the hydrocarbonaceous stream having a reduced concentration of sulfur into a separation zone to produce a vaporous hydrocarbonaceous stream and a liquid hydrocarbonaceous stream having a reduced concentration of sulfur and boiling in a range greater than the vaporous hydrocarbonaceous stream;

(c) introducing at least a portion of the vaporous hydrocarbonaceous stream into a hydrocracking reaction zone containing hydrocracking catalyst to produce an effluent stream comprising naphtha boiling range hydrocarbons;

(d) the hydrocracked effluent stream introduced into a fractionation zone, and the liquid hydrocarbonaceous stream introduced to the fractionation zone bypassing the hydrocracking zone;

(e) recovering naphtha boiling range hydrocarbons; and (f) recovering a hydrocarbonaceous stream as an FCC feedstock.

2. The process of claim 1 wherein the hydrodesulfurization reaction zone is operated at a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$.

3. The process of claim 1 wherein the vaporous hydrocarbonaceous stream produced ha step (b) boils in the range from about 10° C. (50° F.) to about 510° C. (950° F.).

4. The process of claim 1 wherein the hydrocracking reaction zone is operated at a temperature from about 232° C. (450° F.) to about 468° C. (875° F.) and a pressure from about 3.5 MPa (500 psig) to about 17.3 MPa (2500 psig).

5. The process of claim 1 wherein the light cycle oil boils in the range from about 149° C. (300° F.) to about 371° C. (700° F.).

6. The process of claim 1 wherein the vacuum gas oil boils in the range from about 315° C. (600° F.) to about 565° C. (1050° F.).

7. A process for the conversion of a hydrocarbonaceous feedstock wherein the process comprises:

(a) reacting a hydrocarbonaceous feedstock comprising light cycle oil and vacuum gas oil in a hydrodesulfurization reaction zone to produce a hydrocarbonaceous stream having a reduced concentration of sulfur;

(b) introducing at least a portion of the hydrocarbonaceous stream having a reduced concentration of sulfur into a hot, high pressure stripper to produce a vaporous hydrocarbonaceous stream and a liquid hydrocarbonaceous stream having a reduced concentration of sulfur and boiling in a range greater than the vaporous hydrocarbonaceous stream;

(c) introducing at least a portion of the vaporous hydrocarbonaceous stream into a hydrocracking reaction zone containing hydrocracking catalyst to produce an effluent stream comprising naphtha boiling range hydrocarbons;

(d) the hydrocracked effluent stream introduced into a fractionation zone, and the liquid hydrocarbonaceous stream introduced to the fractionation zone bypassing the hydrocracking zone;

(e) recovering naphtha boiling range hydrocarbons; and (f) recovering hydrocarbonaceous stream as an FCC feedstock.

8. The process of claim 7 wherein the hydrodesulfurization reaction zone is operated at a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$.

9. The process of claim 7 wherein the hot, high pressure stripper is operated at a temperature from about 149° C. (300° F.) to about 399° C. (750° F.) and a pressure from about 3.5 MPa (500 psig) to about 17.3 MPa (2500 psig).

10. The process of claim 7 wherein the vaporous hydrocarbonaceous stream produced in step (b) boils in the range from about 10° C. (50° F.) to about 510° C. (950° F.).

11. The process of claim 7 wherein the hydrocracking reaction zone is operated at a temperature from about 232° C. (450° F.) to about 468° C. (875° F.) and a pressure from about 3.5 MPa (500 psig) to about 17.3 MPa (2500 psig).

12. The process of claim 7 wherein the light cycle oil boils in the range from about 149° C. (300° F.) to about 371° C. (700° F.).

13. The process of claim 7 wherein the vacuum gas oil boils in the range from about 315° C. (600° F.) to about 565° C. (1050° F.).

14. A process for the conversion of a hydrocarbonaceous feedstock wherein the process comprises:

(a) reacting a hydrocarbonaceous feedstock comprising light cycle oil and vacuum gas oil in a hydrodesulfurization reaction zone operated at a temperature from about 204° C. (400° F.) to about 482° C. (900° F.), a pressure from about 3.5 MPa (500 psig) to about 17.3 MPa (2500 psig) and a liquid hourly space velocity from about 0.1 $hr^{-1}$ to about 10 $hr^{-1}$ to produce a hydrocarbonaceous stream having a reduced concentration of sulfur;

(b) introducing at least a portion of the hydrocarbonaceous stream having a reduced concentration of sulfur into a hot, high pressure stripper operated at a temperature from about 149° C. (300° F.) to about 399° C. (750° F.) and a pressure from about 3.5 MPa (500 psig) to about 17.3 MPa (2500 psig) to produce a vaporous hydrocarbonaceous stream and a liquid hydrocarbonaceous stream having a reduced concentration of sulfur and boiling in a range greater than the vaporous hydrocarbonaceous stream;

(c) introducing at least a portion of the vaporous hydrocarbonaceous stream into a hydrocracking reaction zone containing hydrocracking catalyst and operated at a temperature from about 232° C. (450° F.) to about 468° C. (875° F.) and a pressure from about 3.5 MPa (500 psig) to about 17.3 MPa (2500 psig) to produce an effluent stream comprising naphtha boiling range hydrocarbons;

(d) the hydrocracked effluent stream introduced into a fractionation zone, and the liquid hydrocarbonaceous stream introduced to the fractionation zone bypassing the hydrocracking zone;

(e) recovering naphtha boiling range hydrocarbons; and (f) recovering a hydrocarbonaceous stream from the fractionation zone as an FCC feedstock.

15. The process of claim 14 wherein the hydrocarbonaceous stream produced in step (b) boils in the range from about 10° C. (50° F.) to about 510° C. (950° F.).

16. The process of claim 14 wherein the light cycle oil boils in the range from about 149° C. (300° F.) to about 371° C. (700° F.).

17. The process of claim 14 wherein the vacuum gas oil boils in the range from about 315° C. (600° F.) to about 565° C. (1050° F.).

18. The process of claim 1 wherein the liquid hydrocarbonaceous stream is substantially free of post-hydrodesulfurization exposure to hydrocracking reaction conditions.

19. The process of claim 7 wherein the liquid hydrocarbonaceous stream is substantially free of post-hydrodesulfurization exposure to hydrocracking reaction conditions.

20. The process of claim 14 wherein the liquid hydrocarbonaceous stream is substantially free of post-hydrodesulfurization exposure to hydrocracking reaction conditions.

* * * * *